US006725842B2

(12) United States Patent
Matsumoto

(10) Patent No.: US 6,725,842 B2
(45) Date of Patent: Apr. 27, 2004

(54) FUEL INJECTION CONTROL DEVICE FOR INTERNAL COMBUSTION ENGINE

(75) Inventor: Norio Matsumoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 102 days.

(21) Appl. No.: 10/139,240

(22) Filed: May 7, 2002

(65) Prior Publication Data

US 2003/0131832 A1 Jul. 17, 2003

(30) Foreign Application Priority Data

Jan. 15, 2002 (JP) ..... 2002-005911

(51) Int. Cl.[7] ..... F02D 41/04; F02D 45/00
(52) U.S. Cl. ..... 123/480; 123/478
(58) Field of Search ..... 123/457, 458, 123/478, 480, 488, 494, 568.22; 701/103, 104

(56) References Cited

U.S. PATENT DOCUMENTS 5,615,657 A * 4/1997 Yoshizawa ..... 123/494
5,718,203 A * 2/1998 Shimada et al. ..... 123/435 X
2001/0023683 A1 * 9/2001 Nakamura et al. ..... 123/457

FOREIGN PATENT DOCUMENTS

| | | |
|---|---|---|
| JP | 11-200918 | 7/1999 |
| JP | 11-315768 | 11/1999 |
| JP | 2001-107776 | 4/2001 |

* cited by examiner

*Primary Examiner*—Tony M. Argenbright
(74) *Attorney, Agent, or Firm*—Sughrue Mion, PLLC

(57) ABSTRACT

A fuel injection control device for an internal combustion engine, includes a rotational speed sensor for detecting rotational speed of the internal combustion engine, intake air quantity sensor for detecting an air quantity taken into the internal combustion engine, atmospheric pressure sensor for detecting atmospheric pressure, and an engine control unit for estimating an inlet pipe pressure of the internal combustion engine from the detected rotational speed and intake air quantity, computing a fuel injection quantity fuel pressure correction coefficient according to a difference between the estimated inlet pipe pressure and the detected atmospheric pressure, and correcting a fuel injection quantity based on the computed fuel injection quantity fuel pressure correction coefficient.

5 Claims, 8 Drawing Sheets

FIG. 2

INLET PIPE PRESSURE DATA PB(Ne,Ec)
IN ENGINE CONTROL UNIT

| | | ROTATIONAL SPEED Ne【r/min】 | | | | |
|---|---|---|---|---|---|---|
| | | 0 | 1000 | ··· | 7000 | 8000 |
| FILLING EFFICIENCY Ec【%】 | 0 | ··· | ··· | ··· | ··· | ··· |
| | 10 | ··· | ··· | ··· | ··· | ··· |
| | ⋮ | ⋮ | ⋮ | ⋮ | ⋮ | ⋮ |
| | 90 | ··· | ··· | ··· | ··· | ··· |
| | 100 | ··· | ··· | ··· | ··· | ··· |

FIG. 3

FUEL PRESSURE CORRECTION
COEFFICIENT DATA IN CONTROL UNIT

| PRESSURE DIFFERENCE (Pa-Pb)〔mmHg〕 | 0 | 50 | 100 | ··· | 700 |
|---|---|---|---|---|---|
| FUEL PRESSURE CORRECTION COEFFICIENT | 1.0 | 0.9 | ··· | ··· | ··· |

FIG. 4

INLET PIPE PRESSURE DATA $PB_{EGRO}(Ne,Ee)$ WITHOUT INTRODUCTION OF EGR IN ENGINE CONTROL UNIT

| | | ROTATIONAL SPEED Ne【r/min】 | | | | |
|---|---|---|---|---|---|---|
| | | 0 | 1000 | ··· | 7000 | 8000 |
| FILLING EFFICIENCY Ec【%】 | 0 | ··· | ··· | ··· | ··· | ··· |
| | 10 | ··· | ··· | ··· | ··· | ··· |
| | ⋮ | ⋮ | ⋮ | ⋮ | ⋮ | ⋮ |
| | 90 | ··· | ··· | ··· | ··· | ··· |
| | 100 | ··· | ··· | ··· | ··· | ··· |

INLET PIPE PRESSURE DATA $PB_{EGR}(Ne,Ec)$ WITH INTRODUCTION OF EGR (TARGET EGR QUANTITY) IN CONTROL UNIT

| | | ROTATIONAL SPEED Ne【r/min】 | | | | |
|---|---|---|---|---|---|---|
| | | 0 | 1000 | ··· | 7000 | 8000 |
| FILLING EFFICIENCY Ec【%】 | 0 | ··· | ··· | ··· | ··· | ··· |
| | 10 | ··· | ··· | ··· | ··· | ··· |
| | ⋮ | ⋮ | ⋮ | ⋮ | ⋮ | ⋮ |
| | 90 | ··· | ··· | ··· | ··· | ··· |
| | 100 | ··· | ··· | ··· | ··· | ··· |

FIG. 5

INLET PIPE PRESSURE DATA $PB_{VVTO}$ (Ne,Ec) DURING VVT NON-OPERATION TIME IN ENGINE CONTROL UNIT

| | | ROTATIONAL SPEED Ne【r/min】 | | | | |
|---|---|---|---|---|---|---|
| | | 0 | 1000 | ··· | 7000 | 8000 |
| FILLING EFFICIENCY Ec【%】 | 0 | ··· | ··· | ··· | ··· | ··· |
| | 10 | ··· | ··· | ··· | ··· | ··· |
| | ⋮ | ⋮ | ⋮ | ⋮ | ⋮ | ⋮ |
| | 90 | ··· | ··· | ··· | ··· | ··· |
| | 100 | ··· | ··· | ··· | ··· | ··· |

INLET PIPE PRESSURE DATA $PB_{VVT}$ (NE,EC) DURING VVT OPERATION TIME (TARGET OPERATION TIME) IN ENGINE CONTROL UNIT

| | | ROTATIONAL SPEED Ne【r/min】 | | | | |
|---|---|---|---|---|---|---|
| | | 0 | 1000 | ··· | 7000 | 8000 |
| FILLING EFFICIENCY Ec【%】 | 0 | ··· | ··· | ··· | ··· | ··· |
| | 10 | ··· | ··· | ··· | ··· | ··· |
| | ⋮ | ⋮ | ⋮ | ⋮ | ⋮ | ⋮ |
| | 90 | ··· | ··· | ··· | ··· | ··· |
| | 100 | ··· | ··· | ··· | ··· | ··· |

FIG. 8

FILLING EFFICIENCY Ecz (Ne, θ) WITH ISC AIR QUANTITY AT LOWER LIMIT IN ENGINE CONTROL UNIT

| | | ROTATIONAL SPEED Ne【r/min】 | | | | |
|---|---|---|---|---|---|---|
| | | 0 | 1000 | ··· | 7000 | 8000 |
| THROTTLE VALVE TRAVEL θ【deg】 | 0 | ··· | ··· | ··· | ··· | ··· |
| | 10 | ··· | ··· | ··· | ··· | ··· |
| | ⋮ | ⋮ | ⋮ | ⋮ | ⋮ | ⋮ |
| | 80 | ··· | ··· | ··· | ··· | ··· |
| | 90 | ··· | ··· | ··· | ··· | ··· |

FILLING EFFICIENCY Ecz (Ne, θ) WITH ISC AIR QUANTITY AT UPPER LIMIT IN ENGINE CONTROL UNIT

| | | ROTATIONAL SPEED Ne【r/min】 | | | | |
|---|---|---|---|---|---|---|
| | | 0 | 1000 | ··· | 7000 | 8000 |
| THROTTLE VALVE TRAVEL θ【deg】 | 0 | ··· | ··· | ··· | ··· | ··· |
| | 10 | ··· | ··· | ··· | ··· | ··· |
| | ⋮ | ⋮ | ⋮ | ⋮ | ⋮ | ⋮ |
| | 80 | ··· | ··· | ··· | ··· | ··· |
| | 90 | ··· | ··· | ··· | ··· | ··· |

FUEL INJECTION CONTROL DEVICE FOR INTERNAL COMBUSTION ENGINE

This application is based on Application No. 2002-005911, filed in Japan on Jan. 15, 2002, the contents of which are hereby incorporated by reference.

BACKGROUND OF THE INVENTION

1. Field of the Invention

The present invention relates to a fuel injection control device for an internal combustion engine, and particularly to a fuel injection control device for an internal combustion engine in a fuel returnless system.

2. Description of the Related Art

FIG. 9 is a block diagram showing a conventional fuel injection control device for an internal combustion engine in a fuel returnless system.

In the figure, reference numeral 1 denotes an internal combustion engine, reference numeral 2 denotes a cylinder, reference numeral 3 denotes a piston, reference numeral 4 denotes a cylinder head, reference numeral 5 denotes a combustion chamber, reference numeral 6 denotes an engine control unit, reference numeral 7 denotes an inlet port, reference numeral 8 denotes an inlet valve, reference numeral 9 denotes an exhaust port, reference numeral 10 denotes an exhaust valve, reference numeral 11 denoted an injector (fuel injection valve), reference numeral 12 denotes a sparking plug, reference numerals 13 and 14 denote actuators, reference numeral 15 denotes a fuel tank, reference numeral 16 denotes a fuel pressure regulator, reference numeral 17 denotes a fuel pipe, reference numeral 18 denotes an inlet manifold, reference numeral 19 denotes an inlet pipe pressure sensor, reference numeral 20 denotes an atmospheric pressure sensor, reference numeral 21 denotes a fuel pump, and reference numeral 22 denotes a delivery pipe.

The engine control unit 6 includes correction coefficient computation means for computing a fuel injection quantity correction coefficient according to a difference between an inlet pipe pressure and an atmospheric pressure detected by the inlet pipe pressure sensor 19 and the atmospheric sensor 20, and fuel injection amount correction means for correcting a fuel injection quantity according to the fuel injection quantity correction coefficient, and it drives the injector 11 in the corrected fuel injection quantity.

In the above-described conventional controller, a volume intake air quantity equivalent value is obtained by an inlet pipe pressure detected by the inlet pipe pressure sensor, but an error from an actual mass intake air quantity sometimes occurs due to influences of intake air temperature, exhaust recirculation gas (EGR) and the like, and when an accurate intake air quantity is to be measured, it is necessary to provide an intake air quantity sensor. However, in this case, if conventional correction of fuel pressure is to be carried out based on the inlet pipe pressure and the atmospheric pressure detected by the inlet pipe pressure sensor and the atmospheric sensor, the inlet pipe pressure sensor, which becomes unnecessary as a result that air quantity measurement with high accuracy is performed, is needed again, whereby the system becomes expensive.

If the correction of the fuel injection quantity based on fuel pressure according to the difference between the inlet pipe pressure and the atmospheric pressure is not carried out in the fuel injection control device using the intake air quantity sensor to measure the above-described intake air quantity with high accuracy, accuracy of the fuel injection quantity reduces sharply.

When exhaust gas recirculation equipment, a variable valve timing mechanism and the like are provided in a fuel injection control device using the intake air quantity sensor as described above, even if the same quantity of mass intake air is detected in the intake air quantity sensor, the inlet pipe pressure changes according to the quantities of an outer exhaust recirculation gas by the exhaust gas recirculation equipment and an inner exhaust recirculation gas by the variable valve timing mechanism. In this case, accuracy of a fuel injection quantity reduces sharply, if the correction of the inlet pipe pressure estimated with rotational speed and filling efficiency, which is used for fuel pressure correction, by exhaust gas recirculation control quantity and variable valve timing control quantity is not carried out and the correction of the fuel injection quantity by fuel pressure using the corrected inlet pipe pressure is not carried out.

SUMMARY OF THE INVENTION

The present invention is made to eliminate the above-described disadvantage, and its object is to provide a fuel injection control device for an internal combustion engine that is less expensive with high accuracy.

The fuel injection control device for the internal combustion engine according to the invention is a fuel injection control device for an internal combustion engine for supplying fuel at a constant pressure to an injector of each cylinder via a fuel pipe and a delivery pipe by a fuel pump and a fuel pressure regulator disposed in a fuel tank of the internal combustion engine, and includes rotational speed detection means for detecting rotational speed of the aforesaid internal combustion engine, intake air quantity detection means for detecting an air quantity taken into the aforesaid internal combustion engine, atmospheric pressure detection means for detecting atmospheric pressure; and correction means for estimating an inlet pipe pressure of the internal combustion engine from the detected rotational speed and intake air quantity, computing a fuel injection quantity fuel pressure correction coefficient according to a difference between the estimated inlet pipe pressure and the aforementioned detected atmospheric pressure, and correcting a fuel injection quantity based on the computed fuel injection quantity fuel pressure correction coefficient.

The fuel injection control device for the internal combustion engine according to the invention includes control means for controlling a recirculation quantity of exhaust gas recirculation equipment, and the aforesaid correction means corrects the inlet pipe pressure estimated from the detected rotational speed and intake air quantity according to the aforementioned recirculation quantity, computes the fuel injection quantity fuel pressure correction coefficient according to the difference between the corrected inlet pipe pressure and the detected atmospheric pressure, and corrects the fuel injection quantity according to the computed fuel injection quantity fuel pressure correction coefficient.

The fuel injection control device for the internal combustion engine according to the invention includes control means for controlling a variable valve timing of a variable valve timing mechanism, and the aforesaid correction means corrects the inlet pipe pressure estimated from the aforementioned detected rotational speed and intake air quantity according to the aforementioned variable valve timing, computes the fuel injection quantity fuel pressure correction coefficient according to the difference between the corrected inlet pipe pressure and the aforementioned detected atmospheric pressure, and corrects the fuel injection quantity according to the computed fuel injection quantity fuel pressure correction coefficient.

The fuel injection control device for the internal combustion engine according to the invention is a fuel injection control device for an internal combustion engine for supplying fuel at a constant pressure to an injector of each cylinder via a fuel pipe and a delivery pipe by a fuel pump and a fuel pressure regulator disposed in a fuel tank of the internal combustion engine, and includes rotational speed detection means for detecting rotational speed of the aforesaid internal combustion engine, intake air quantity detection means for detecting an air quantity taken into the aforesaid internal combustion engine, throttle valve travel detection means for detecting an valve travel of a throttle valve of the aforesaid internal combustion engine, inlet pipe pressure detection means for detecting an inlet pipe pressure of the aforesaid internal combustion engine, and correction means for estimating atmospheric pressure from the detected inlet pipe pressure, rotational speed, throttle valve travel and intake air quantity, computing a fuel injection quantity fuel pressure correction coefficient according to a difference between the estimated atmospheric pressure and the aforesaid detected inlet pipe pressure, and correcting a fuel injection quantity according to the computed fuel injection quantity fuel pressure correction coefficient.

The fuel injection control device for the internal combustion engine according to the invention is a fuel injection control device for an internal combustion engine for supplying fuel at a constant pressure to an injector of each cylinder via a fuel pipe and a delivery pipe by a fuel pump and a fuel pressure regulator disposed in a fuel tank of the internal combustion engine, and includes rotational speed detection means for detecting rotational speed of the aforesaid internal combustion engine, intake air quantity detection means for detecting an air quantity taken into the aforesaid internal combustion engine, throttle valve travel detection means for detecting an valve travel of a throttle valve of the aforesaid internal combustion engine, and correction means for estimating atmospheric pressure from the detected rotational speed, throttle valve travel and intake air quantity and estimating an inlet pipe pressure of the internal combustion engine from the aforementioned detected rotational speed and intake air quantity, computing a fuel injection quantity fuel pressure correction coefficient according to a difference between the estimated atmospheric pressure and inlet pipe pressure, and correcting a fuel injection quantity according to the computed fuel injection quantity fuel pressure correction coefficient.

BRIEF DESCRIPTION OF THE DRAWINGS

FIG. 2 is a diagram used for explanation of an operation of the first embodiment of the present invention;

FIG. 3 is a diagram used for explanation of the operation of the first embodiment of the present invention;

FIG. 4 is a diagram used for explanation of an operation of a second embodiment of the present invention;

FIG. 5 is a diagram used for explanation of an operation of a third embodiment of the present invention;

FIG. 8 is a diagram used for explanation of operations of the fourth and a fifth embodiment of the present invention.

DETAILED DESCRIPTION OF THE PREFERRED EMBODIMENTS

Preferred embodiments of the present invention will be explained below based on the drawings.

First Embodiment

Figure 1:
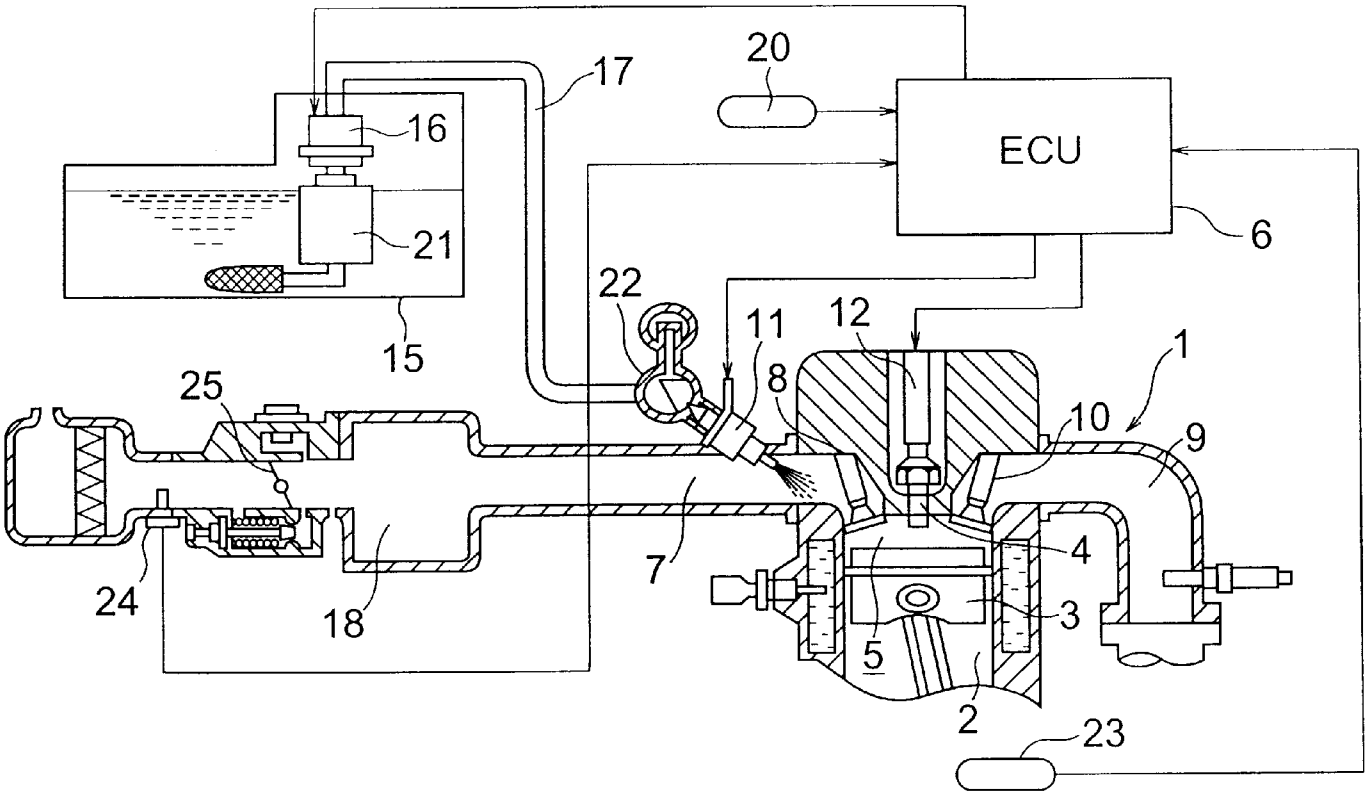
FIG. 1 is a block diagram showing a first embodiment of the present invention.

FIG. 1 is a block diagram showing a first embodiment of the present invention.

In FIG. 1, reference numeral 1 denotes an internal combustion engine, reference numeral 2 denotes a cylinder, reference numeral 3 denotes a piston, reference numeral 4 denotes a cylinder head, reference numeral 5 denotes a combustion chamber, reference numeral 6 denotes an engine control unit as correction means, reference numeral 7 denotes an inlet port, reference numeral 8 denotes an inlet valve, reference numeral 9 denotes an exhaust port, reference numeral 10 denotes an exhaust valve, reference numeral 11 denotes an injector (fuel injection valve) controlled according to a control signal from the engine control unit 6, reference numeral 12 denotes a sparking plug, reference numeral 15 denotes a fuel tank, reference numeral 16 denotes a fuel pressure regulator, reference numeral 17 denotes a fuel pipe, reference numeral 18 denotes an inlet manifold, reference numeral 20 denotes an atmospheric pressure sensor as atmospheric pressure detection means, reference numeral 21 denoted a fuel pump, reference numeral 22 denotes a delivery pipe, reference numeral 23 is a rotational speed sensor as rotational speed detection means, reference numeral 24 is an intake air quantity sensor as intake air quantity detection means, and reference numeral 25 denotes a throttle valve.

Next, an operation will be explained with reference to FIG. 2 to FIG. 3.

Inlet pipe pressure data Pb (Ne, Ec), corresponding to rotational speed Ne detected by the rotational speed sensor 23 and filling efficiency Ec to the cylinder calculated from an intake air quantity detected by the intake air quantity sensor 24, is stored in the engine control unit 6 as the data shown in FIG. 2, and correction is made by multiplying a basic fuel injection quantity computed from the filling efficiency Ec by a fuel pressure correction coefficient stored in the engine control unit 6 as the data shown in FIG. 3, which is corresponding to pressure difference (Pa−Pb) between the inlet pipe pressure according to an engine operation state expressed by the rotational speed Ne and the filling efficiency Ec and the atmospheric pressure Pa detected by the atmospheric pressure sensor 20.

Subsequently, the engine control unit 6 drives the fuel pump 21, feeds the fuel adjusted at predetermined pressure in the fuel pressure regulator 16 to the injector 11 by pressure, converts the fuel injection quantity with the aforementioned fuel pressure correction being performed into driving time of the injector 11 and drive it, supplies the inlet port 7 with a suitable quantity of fuel corresponding to an air quantity taken into the cylinder 2 of the engine and fuel pressure to thereby operate the engine at a suitable air fuel ratio.

As described above, in the present embodiment, in the fuel injection control device using the intake air quantity sensor, the inlet pipe pressure data according to the filling efficiency to the cylinder, which is calculated from the rotational speed and the intake air quantity, is stored in the control unit, and correction is made by multiplying the basic fuel injection quantity computed from the filling efficiency by the fuel pressure correction coefficient corresponding to the pressure difference between the inlet pipe pressure according to the engine operation state and the atmospheric pressure detected by the sensor, and therefore the inexpensive and highly accurate fuel injection control device without an inlet pipe pressure sensor can be realized without being influenced by the intake air temperature and the like.

Second Embodiment

FIG. 4 is a diagram showing data used in a second embodiment of the present invention.

In this embodiment, as its configuration, the same of which as in the above-described first embodiment is used. However, it should be noted that exhaust gas recirculation equipment (EGR) is provided other than the above, though it is not shown.

In this embodiment, in a system in which the engine control unit 6 controls the exhaust gas recirculation equipment, inlet pipe pressure data PbEGRO (Ne, Ec) according to the rotational speed Ne and the filling efficiency Ec without the introduction of the exhaust recirculation gas (EGR), and inlet pipe pressure data PbEGR (Ne, Ec) according to the rotational speed Ne and the filling efficiency Ec with the introduction of a target EGR quantity QEGR (Ne, Ec) set in the engine control unit 6 according to the rotational speed Ne and the filling efficiency Ec are stored in the engine control unit 6 as the data shown in FIG. 4, and interpolation is made for two of the inlet pipe pressure data PbEGRO (Ne, Ec) and PbEGR (Ne, Ec) according to an actual EGR quantity QEGR controlled in the engine control unit 6 to calculate the inlet pipe pressure Pb in accordance with the following equation.

$$Pb=\{Pb_{EGR}(Ne, Ec)-Pb_{EGRO}(Ne, Ec)\}\times\{Q_{EGR}/Q_{EGR}(Ne, Ec)\}+Pb_{EGRO}(Ne, Ec) \quad (1)$$

In the above equation (1), $Pb_{EGR}$ (Ne, Ec) is the inlet pipe pressure (with introduction of EGR), $Pb_{EGRO}$ (Ne, Ec) is the inlet pipe pressure (without introduction of EGR), $Q_{EGR}$ is an EGR introduction amount (control amount), and $Q_{EGR}$ (Ne, Ec) is a target EGR introduction amount.

Next, based on the above equation (1), the fuel pressure correction as shown in FIG. 3 is found in the same manner as described above, and the basic fuel quantity is corrected. Subsequently, the injector 11 is driven as in the above-described first embodiment to supply a suitable quantity of fuel and operate the engine.

In this manner, in the second embodiment, the inlet pipe pressure data according to the rotational speed and the filling efficiency without introduction of the EGR, and inlet pipe pressure data with introduction of the target. EGR quantity according to the rotational speed and the filling efficiency are stored in the control unit, and interpolation is made for two of the inlet pipe pressure data according to an EGR quantity, whereby the inlet pipe pressure is calculated, then the fuel pressure correction is obtained and the basic fuel quantity is corrected as in the above-described first embodiment. Accordingly, even when the exhaust gas recirculation equipment is provided, the fuel injection control device, which is less expensive and highly accurate corresponding to the quantity of recirculation gas without an inlet pipe pressure sensor, can be realized.

Third Embodiment

FIG. 5 is a diagram showing data used in a third embodiment of the present invention.

In this embodiment, as its configuration, the same of which as in the above-described first embodiment is used. However, it should be noted that a variable valve timing mechanism (VVT) is provided other than the above, though it is not shown.

In this embodiment, in a system in which the engine control unit 6 controls the variable valve timing mechanism, inlet pipe pressure data $Pb_{VVTO}$ (Ne, Ec) and $Pb_{VVT}$ (Ne, Ec) according to the rotational speeds Ne and the filling efficiencies Ec in two states: the state without the operation of the VVT and the state with target operation timing QVVT (Ne, Ec) set inside the engine control unit 6 according to the rotational speed Ne and the filling efficiency Ec are stored in the engine control unit 6 as the data shown in FIG. 5, and interpolation is made for two of the inlet pipe pressure data $Pb_{VVTO}$ (Ne, Ec) and $Pb_{VVT}$ (Ne, Ec) according to a VVT operation amount $Q_{VVT}$ to calculate the inlet pipe pressure Pb in accordance with the following equation.

$$Pb=\{Pb_{VVT}(Ne, Ec)-Pb_{VVTO}(Ne, Ec)\}\times\{Q_{VVT}/Q_{VVT}(Ne, Ec)\}+Pb_{VVTO}(Ne, Ec) \quad (2)$$

In the above equation (2), $Pb_{VVT}$ (Ne, Ec) is the inlet pipe pressure (with operation of VVT), $Pb_{VVTO}$ (Ne, Ec) is the inlet pipe pressure (without operation of VVT), $Q_{VVT}$ is a VVT operation amount (control amount), and $Q_{VVT}$ (Ne, Ec) is a target VVT operation amount.

Next, based on the above equation (2), the fuel pressure correction as shown in FIG. 3 is obtained in the same manner as described above, and the basic fuel quantity is corrected. Subsequently, the injector 11 is driven as in the above-described first embodiment to supply a suitable quantity of fuel and operate the engine.

As described above, in this embodiment, the inlet pipe pressure data according to the rotational speeds and the filling efficiencies in two states: the state without the operation of the VVT and the state with the target operation timing are stored in the control unit, and interpolation is made for two of the inlet pipe pressure data according to the VVT operation amount, whereby the inlet pipe pressure is calculated, the fuel pressure correction is obtained in the same manner as in the above-described first embodiment, and the basic fuel quantity is corrected. Accordingly, even when the valuable valve timing mechanism is provided, the fuel injection control device, which is less expensive and highly accurate corresponding to the VVT control amount without an inlet pipe pressure sensor, can be realized.

Fourth Embodiment

Figure 6:
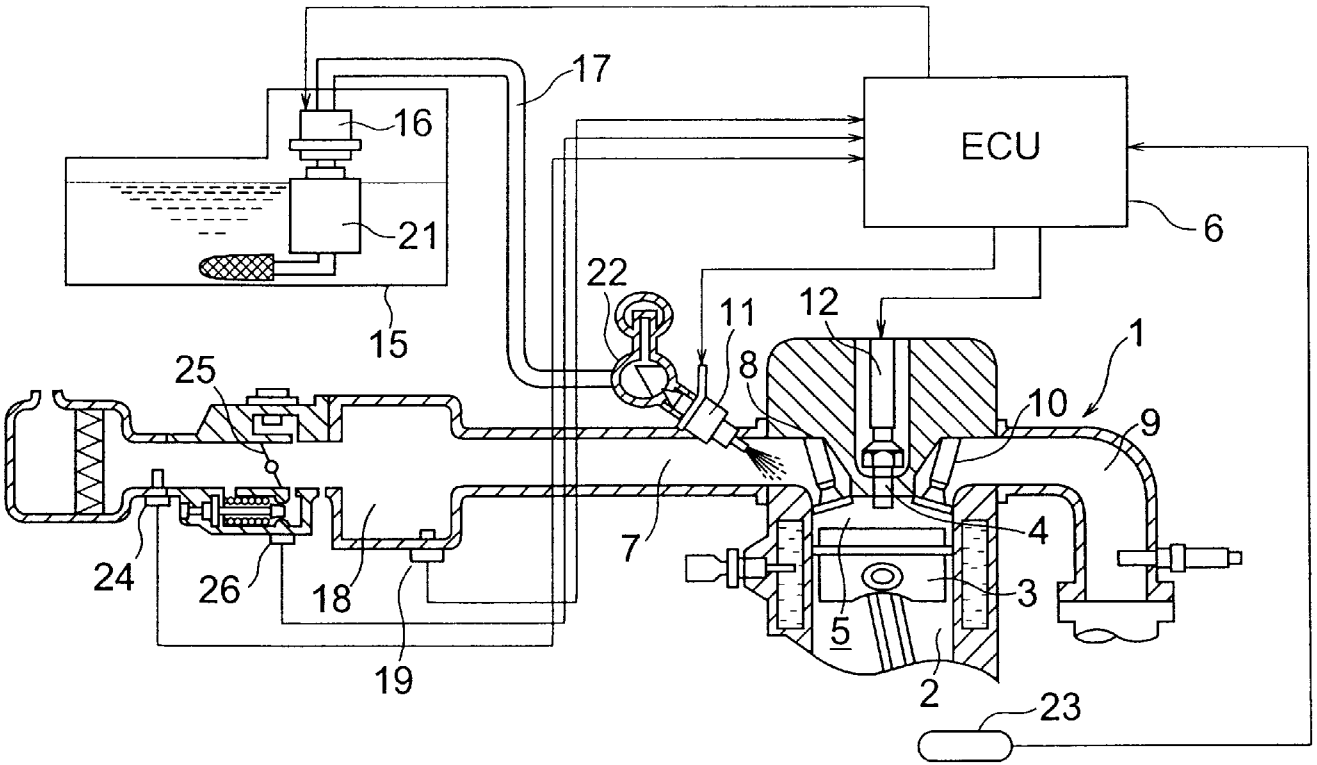
FIG. 6 is a block diagram showing a fourth embodiment of the present invention.

FIG. 6 is a block diagram showing a fourth embodiment of the present invention. In FIG. 6, the components corresponding to FIG. 1 are given the identical reference characters and numerals and the repeated explanation thereof will be avoided.

In FIG. 6, reference numeral 19 denotes an inlet pipe pressure sensor as inlet pipe pressure detection means, and reference numeral 26 denotes a throttle valve travel sensor as throttle valve travel detection means.

Next, an operation will be explained with reference to FIG. 7 to FIG. 8.

Figure 7:
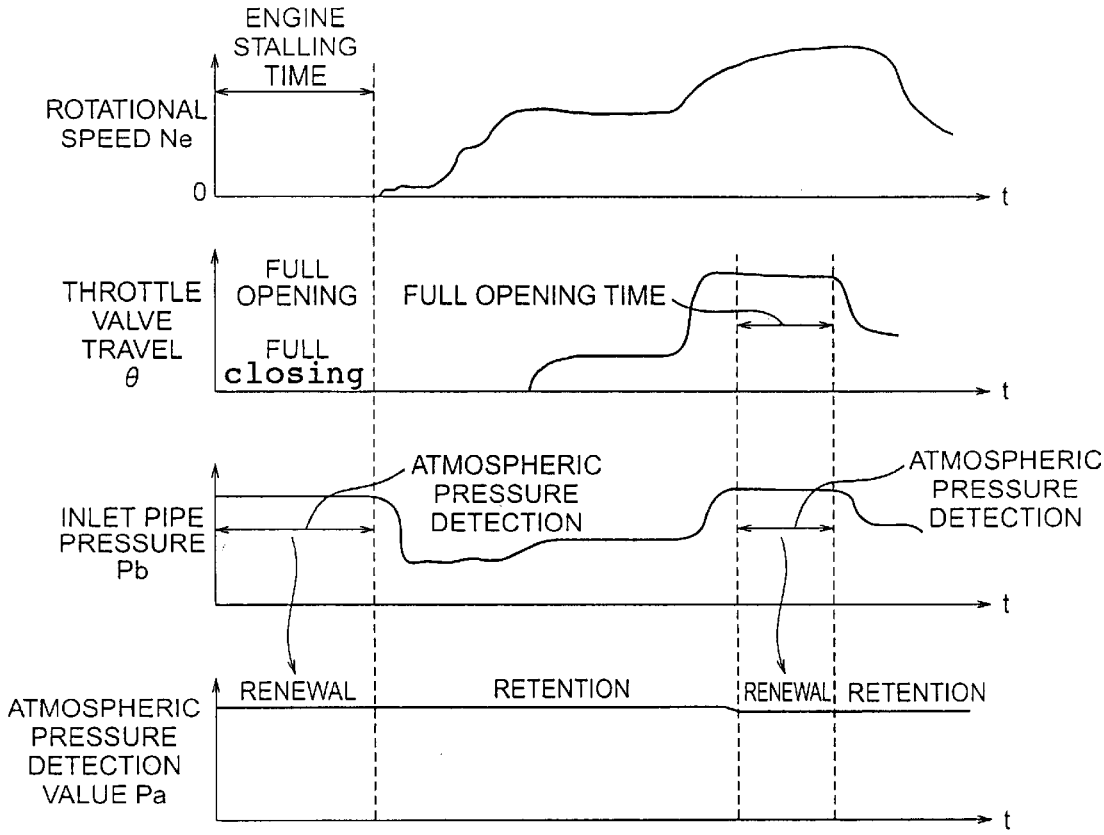
FIG. 7 is a diagram used for explanation of an operation of a fourth embodiment of the present invention.
Figure 9:
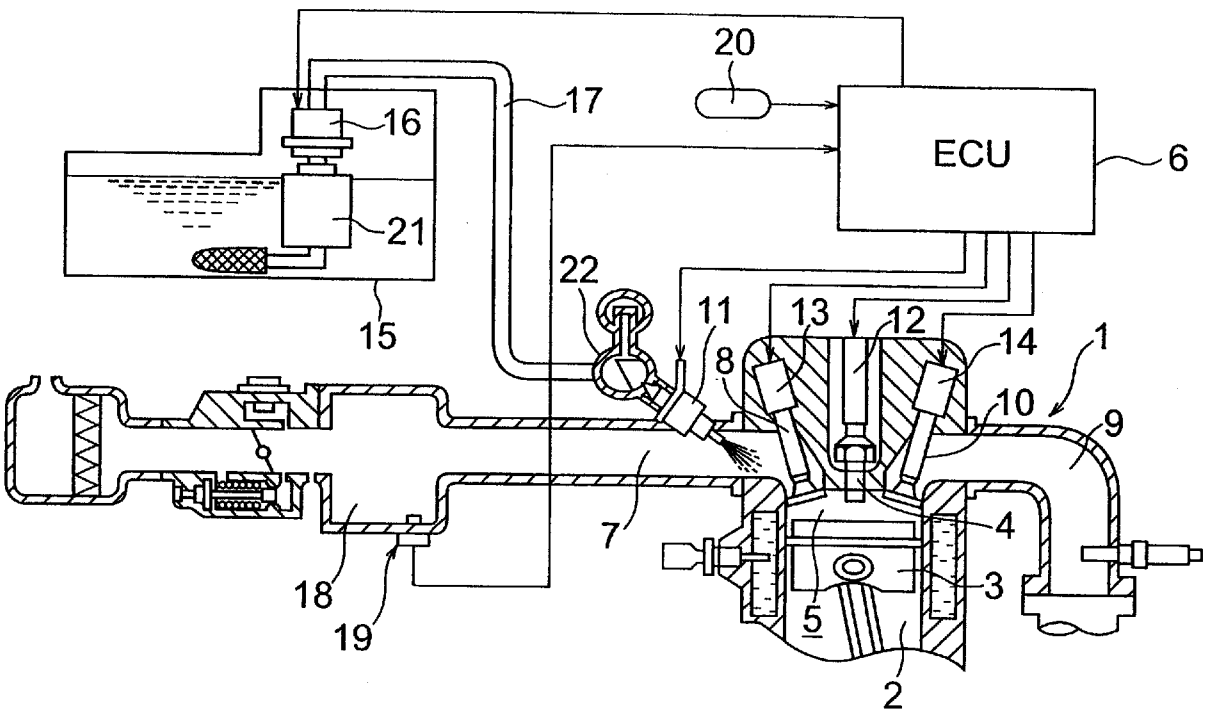
PRIOR ART FIG. 9
FIG. 9 is a block diagram showing a conventional fuel injection control device for an internal combustion engine.

In the engine control unit 6, correction is made by multiplying a basic fuel injection quantity computed from the filling efficiency Ec by the fuel pressure correction coefficient corresponding to a pressure difference between the atmospheric pressure Pa, which is detected from the inlet pipe pressure of the inlet pipe pressure sensor 19 during engine stopping time (engine stalling) or during full opening time of the throttle valve 25 shown in the operation diagram of the engine in FIG. 7, and the inlet pipe pressure Pb detected from the inlet pipe pressure sensor 19 according to the engine operation state.

In the engine controller unit 6, the atmospheric pressure Pa is calculated according to the following equation from filling efficiency data $E_{CZ}$ (Ne, θ) at the time of an idle speed control (ISC) air control amount being at a lower limit value $Q_{ISCZ}$ and filling efficiency data $E_{CF}$ (Ne, θ) at the time of an ISC air control amount being at an upper limit value $Q_{ISCF}$, which are corresponding to the rotational speed Ne detected from a signal from the rotational speed sensor 23 and a throttle valve travel θ detected by the throttle valve travel sensor 26 and are stored in the engine control unit 6 as the data shown in FIG. 8, and the filling efficiency Ec detected by the intake air quantity sensor 24 and the ISC air control amount $Q_{ISC}$.

$$Pa=K\times Ec\times(Q_{ISCF}-Q_{ISCZ})/\{E_{CZ}(Ne,\theta)\times(Q_{ISCZ}-Q_{ISC})+E_{CF}(Ne,\theta)\times(Q_{ISC}-Q_{ISCF})\} \quad (3)$$

In the above equation (3), $E_{CZ}$ (Ne, θ) is the filling efficiency at the ISC air control amount upper limit value, $E_{CF}$ (Ne, θ) is the filling efficiency at the ISC air control amount lower limit value, Ec is the filling efficiency (detection value), $Q_{ISC}$ is the ISC air control amount, $Q_{ISCZ}$ is the ISC air control amount lower limit value, $Q_{ISCF}$ is the ISC air control amount upper limit value, and K is a conversion coefficient.

Correction is carried out by multiplying the basic fuel injection quantity computed from the filling efficiency Ec by the fuel pressure correction coefficient, which is according to the pressure difference (Pa−Pb) between the atmospheric pressure Pa obtained from this equation (3) and the inlet pipe pressure Pb detected from the inlet pipe pressure sensor 19 according to the engine operation state and is stored in the control unit 6 as the data shown in the above-described FIG. 3. Subsequently, the injector 11 is driven in the same manner as in the above-described first embodiment, and a suitable quantity of fuel is supplied to operate the engine.

As described above, in this embodiment, correction is made by multiplying the basic fuel injection quantity computed from the filling efficiency by the fuel pressure correction coefficient corresponding to the pressure difference between the atmospheric pressure detected from the inlet pipe pressure during engine stopping time or throttle full opening time or the atmospheric pressure obtained by calculating the filling efficiency data according to the rotational speed and throttle position and the detected filling efficiency, and the inlet pipe pressure according to the engine operation state, and thereby the fuel injection control device as inexpensive as in the above-described embodiments with high accuracy can be realized, with the inlet pipe pressure sensor being provided instead of the atmospheric pressure sensor, which is deleted.

Fifth Embodiment

In this embodiment, by the engine control unit 6, the inlet pipe pressure Pb is calculated with any one of the methods of the above-described first to third embodiments, and the atmospheric pressure Pa is calculated from the filling efficiency data $E_{CZ}$ (Ne, θ) and $E_{CF}$ (Ne, θ) according to the rotational speed Ne and the throttle valve travel θ as shown in the above-described FIG. 8, the detected filling efficiency Ec and ISC control amount $Q_{ISC}$, whereby the fuel pressure correction coefficient as shown in the above-described FIG. 3 is determined and the basic fuel injection quantity is corrected without any of the inlet pipe pressure sensor 19 or the atmospheric sensor 20. Subsequently, the injector 11 is driven as in the above-described first embodiment, and a proper quantity of fuel is supplied to operate the engine.

As described above, in this embodiment, the fuel injection control device which estimates the inlet pipe pressure and the atmospheric pressure without the inlet pipe pressure sensor and the atmospheric sensor and is less expensive with high accuracy.

What is claimed is:

1. A fuel injection control device for an internal combustion engine for supplying fuel at a constant pressure to an injector of each cylinder via a fuel pipe and a delivery pipe by a fuel pump and a fuel pressure regulator disposed in a fuel tank of the internal combustion engine, comprising:

rotational speed detection means for detecting rotational speed of said internal combustion engine;

intake air quantity detection means for detecting an air quantity taken into said internal combustion engine;

atmospheric pressure detection means for detecting atmospheric pressure; and correction means for estimating an inlet pipe pressure of the internal combustion engine from the detected rotational speed and intake air quantity, computing a fuel injection quantity fuel pressure correction coefficient according to a difference between the estimated inlet pipe pressure and the detected atmospheric pressure, and correcting a fuel injection quantity based on the computed fuel injection quantity fuel pressure correction coefficient.

2. The fuel injection control device for the internal combustion engine according to claim 1, further comprising control means for controlling a recirculation quantity of exhaust gas recirculation equipment, wherein said correction means corrects the inlet pipe pressure estimated from the detected rotational speed and intake air quantity according to the recirculation quantity, computes the fuel injection quantity fuel pressure correction coefficient according to the difference between the corrected inlet pipe pressure and the detected atmospheric pressure, and corrects the fuel injection quantity according to the computed fuel injection quantity fuel pressure correction coefficient.

3. The fuel injection control device for the internal combustion engine according to claim 1, further comprising control means for controlling a variable valve timing of a variable valve timing mechanism, wherein said correction means corrects the inlet pipe pressure estimated from the detected rotational speed and intake air quantity according to the variable valve timing, computes the fuel injection quantity fuel pressure correction coefficient according to the difference between the corrected inlet pipe pressure and the detected atmospheric pressure, and corrects the fuel injection quantity according to the computed fuel injection quantity fuel pressure correction coefficient.

4. A fuel injection control device for an internal combustion engine for supplying fuel at a constant pressure to an injector of each cylinder via a fuel pipe and a delivery pipe by a fuel pump and a fuel pressure regulator disposed in a fuel tank of the internal combustion engine, comprising:

rotational speed detection means for detecting rotational speed of said internal combustion engine;

intake air quantity detection means for detecting an air quantity taken into said internal combustion engine;

throttle valve travel detection means for detecting an valve travel of a throttle valve of said internal combustion engine;

inlet pipe pressure detection means for detecting an inlet pipe pressure of said internal combustion engine; and correction means for estimating atmospheric pressure from the detected inlet pipe pressure, rotational speed, throttle valve travel and intake air quantity, computing a fuel injection quantity fuel pressure correction coefficient according to a difference between the estimated atmospheric pressure and the detected inlet pipe pressure, and correcting a fuel injection quantity according to the computed fuel injection quantity fuel pressure correction coefficient.

5. A fuel injection control device for an internal combustion engine for supplying fuel at a constant pressure to an injector of each cylinder via a fuel pipe and a delivery pipe by a fuel pump and a fuel pressure regulator disposed in a fuel tank of the internal combustion engine, comprising:

rotational speed detection means for detecting rotational speed of said internal combustion engine;

intake air quantity detection means for detecting an air quantity taken into said internal combustion engine;

throttle valve travel detection means for detecting an valve travel of a throttle valve of said internal combustion engine; and correction means for estimating atmospheric pressure from the detected rotational speed, throttle valve travel and intake air quantity and estimating an inlet pipe pressure of the internal combustion engine from the detected rotational speed and intake air quantity, computing a fuel injection quantity fuel pressure correction coefficient according to a difference between the estimated atmospheric pressure and the inlet pipe pressure, and correcting a fuel injection quantity according to the computed fuel injection quantity fuel pressure correction coefficient.

* * * * *